United States Patent [19]

Ziehn

[11] Patent Number: 4,577,646

[45] Date of Patent: Mar. 25, 1986

[54] PROCESS FOR IMPROVING THE FILLABILITY OF TOBACCO

[75] Inventor: Klaus-Dieter Ziehn, Pinneberg, Fed. Rep. of Germany

[73] Assignee: H.F. & Ph.F Reemtsma GmbH & Co., Hamburg, Fed. Rep. of Germany

[21] Appl. No.: 602,425

[22] Filed: Apr. 20, 1984

[30] Foreign Application Priority Data

Apr. 21, 1983 [DE] Fed. Rep. of Germany ..... 3314474

[51] Int. Cl.[4] ..... A24B 3/18

[52] U.S. Cl. ..... 131/296; 131/292

[58] Field of Search ..... 131/900, 292, 290, 291, 131/294, 296, 300

[56] References Cited

U.S. PATENT DOCUMENTS

| | | | |
|---|---|---|---|
| 4,235,250 | 11/1980 | Utsch | 131/296 |
| 4,289,148 | 9/1981 | Ziehn | 131/291 |
| 4,340,073 | 7/1982 | dela Burde et al. | 131/294 |
| 4,460,000 | 7/1984 | Steinberg | 131/296 |
| 4,461,310 | 7/1984 | Ziehn | 131/296 |

FOREIGN PATENT DOCUMENTS

| | | | |
|---|---|---|---|
| 2115677 | 9/1983 | United Kingdom | 131/296 |

*Primary Examiner*—V. Millin

*Assistant Examiner*—H. Macey

*Attorney, Agent, or Firm*—Cushman, Darby & Cushman

[57] ABSTRACT

Process for improving the fillability of tobacco, such as cut tobacco leaves or ribs and tobacco additives by treating the tobacco in an autoclave with a containing nitrogen and/or argon at pressures up to 1000 bar, with subsequent decompression and a gas heat treatment. The tobacco or the treatment gas supplied to the reactor and/or the decompression step are carried out in such a way that the discharged tobacco which is thereafter supplied to a subsequent heat treatment has a temperature, at introduction to the heat treatment step, below 0° C. This is achieved by precooling the treatment gas prior to supplying it to the autoclave or cooling the treatment gas while supplying it to the autoclave and/or additionally cooling the autoclave and/or precooling the tobacco and/or injecting subcooled or liquefied treatment gas into the autoclave. The process includes multistage treatment gas whereby supply and decompression steps are carried out in a cascade-like manner.

18 Claims, 3 Drawing Figures

PROCESS FOR IMPROVING THE FILLABILITY OF TOBACCO

BACKGROUND OF THE INVENTION

1. Field of the Invention

The present invention relates to a process for improving the fillability of tobacco, such as cut tobacco leaves or ribs or tobacco additives by treatment with a nitrogen and/or argon-containing treatment gas at pressures up to 1000 bar in an autoclave and a heat treatment following the decompression.

2. Background of the Invention

Processes of this type are known from German Pat. No. 2,903,300 and related Ziehn U.S. Pat. No. 4,289,148, the entire disclosure of which is hereby incorporated by reference and relied upon and German Pat. No. 3,119,330 and related Ziehn U.S. application Ser. No. 378,390 filed May 14, 1982, now U.S. Pat. No. 4,461,310, the entire disclosure of which is hereby incorporated by reference and relied upon. In these processes, during the high pressure gas treatment with nitrogen, working takes place in the range 150 to 1000 bar and during treatment with argon in the pressure range 50 to 800 bar.

The problem of the present invention is to improve these known processes and in particular to perform them economically and continuously. A further problem of the invention is to improve the fillability of those tobacco types or additives, which cannot be swollen in a satisfactory manner by the known processes.

Hereinafter, the term tobacco not only covers cut tobacco leaves and ribs, but also torn tobacco leaves, such as are used in cigar manufacture, as well as other tobacco products and additives.

Tobacco additives, inter alia, include the following fibrous natural products: buds of Cinnamomum Lassia, seeds of *Apium graveoleus,* cellulose fibres, *Eugenia caryophyllata*, seeds of *Cumium cymium,* various dried fruits of, e.g., apples, plums, figs, as well as roots of *Glycyrriza glabra*, as well as *Folium liatris.*

SUMMARY OF THE INVENTION

According to the present invention, the above-problem is solved by the present process which provides for improved fillability of tobacco, such as cut tobacco leaves or ribs or tobacco additives by treating the tobacco with a nitrogen and/or argon-containing treatment gas at pressures up to 1000 bar in an autoclave, conducting a decompression step and a heat treatment step thereafter wherein the treatment gas supply and/or the decompression step are carried out in such a way that the discharged tobacco which is supplied to a subsequent heat treatment has a temperature at introduction to the heat treatment of below 0° C.

The invention is described in greater detail hereinafter relative to the examples and drawings.

DETAILED DESCRIPTION

Figure 1:
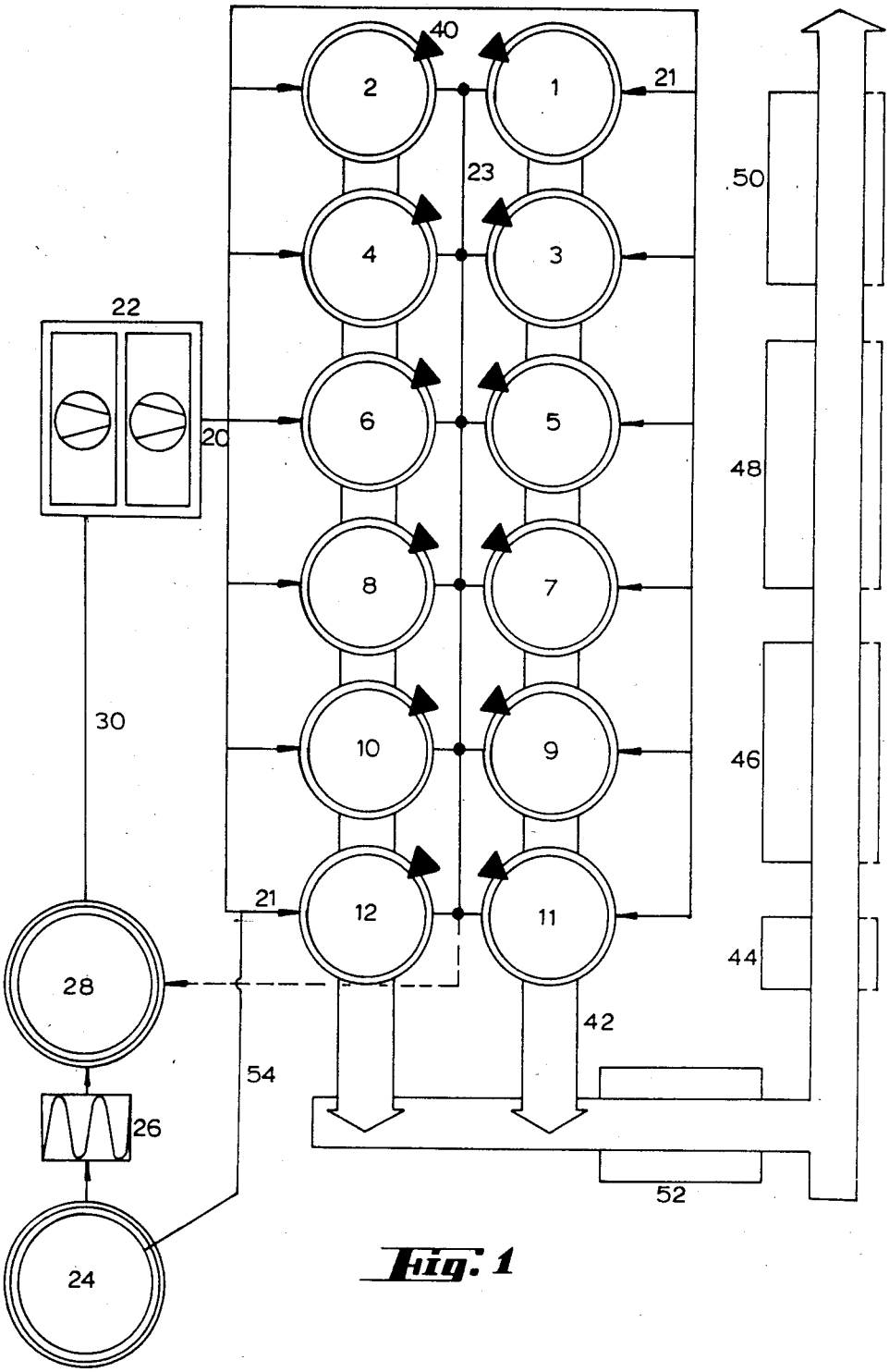
FIG. 1 a diagrammatic view of an installation for performing the process according to the invention.

The present invention relates to a process for improving the fillability of tobacco, such as cut tobacco leaves or stems and tobacco additives by treating the tobacco in an autoclave with a nitrogen and/or argon-containing gas at pressures to 1000 bar, with subsequent decompression and a heat treatment. According to the invention, the tobacco or treatment gas supplied to the reactor and/or the decompression step are carried out in such a way that the discharged tobacco which is thereafter supplied to a subsequent heat treatment has a temperature, at introduction to the heat treatment step, below 0° C. This is achieved by precooling the treatment gas prior to supplying it to the autoclave or cooling the treatment gas while supplying it to the autoclave and/or additionally cooling the autoclave and/or precooling the tobacco and/or injecting subcooled or liquefied treatment gas into the autoclave. The invention more particularly relates to a process with multistage supply and decompression steps carried out in a cascade-like manner.

Preferably, one or more of the following features are also included in the basic novel process.

1. The treatment gas is precooled prior to being supplied to the autocalve or it is cooled while it is supplied to the autoclave.

2. There is additional cooling of the autoclave in which the tobacco is treated with treatment gas.

3. The tobacco is precooled prior to its introduction into the autoclave.

4. Subcooled treatment gas is injected into the autoclave during the treatment of the tobacco with the treatment gas.

5. The action with the treatment gas and the decompression are performed in cascade-like manner with a plurality of autoclaves. This cascade-like process is conducted in such a way that the pressure build-up of the treatment gas in autoclave is obtained by the stepwise use of a treatment gas at a higher pressure, from another autoclave, to an autoclave at a lower pressure thereby resulting from the decompression of one autoclave while raising the pressure of the other.

6. The pressure increase and decrease takes place in stepwise manner with additional treatment gas being forced into one autoclave during its final compression stage to increase the pressure up to the final desired pressure.

7. The treatment gas which is supplied in a cascade-like manner from one autoclave under high pressure to another autoclave under a lower pressure is additionally cooled during the transfer of gas from the autoclave under higher pressure to the autoclave under lower pressure.

8. During the final stage of the compression, the autoclave is charged with subcooled or liquified treatment gas.

9. After decompression and up to the subsequent heat treatment, the tobacco is protected with low temperature insulation to prevent any heating.

10. The subsequent heat treatment is carried out with water vapor in the form of saturated steam or with water vapor having a density of 0.5 to 10 kg/m$^3$ or with hot air having a temperature of up to 440° C.

11. The treating gas is introduced into the autoclave from underneath the autoclave or from a side of the autoclave.

12. After the final pressure has been reached, the autoclave is decompressed via the top or through the bottom of the autoclave.

13. The treating gas is introduced into an annular space within the autoclave. The annular space is defined in its outer configuration by the inner wall of the autoclave and in its inner side by a cylindrical wall having openings leading into the inner part of the autoclave.

It has surprisingly been found that it is important for obtaining an improvement in the fillability or a high degree of swellability that after pressure treatment, i.e., after decompression of the autoclave and discharge therefrom, the tobacco is supplied to the subsequent heat treatment such that the tobacco has a temperature at inlet of lower than 0° C. If the tobacco is discharged from the autoclave at a higher temperature, or if the tobacco absorbs heat after discharge and, e.g., when being conveyed over a long distance from the autoclave to the heat treatment station, there are obtained less satisfactory swelling effects.

The knowledge that the supplying of the autoclave with the tobacco or with the treatment gas and/or the decompression thereof must be controlled in such a way that the discharged tobacco supplied to the subsequent heat treatment has an inlet temperature for the heat treatment below 0° C. is surprising in connection with obtaining a good swelling effect, particularly in the case of a product which per se can only undergo limited swelling.

The substantial advantage of maintaining a minimum inlet temperature of the tobacco from the heat treatment of below 0° C. is that improved swelling effects are obtained compared with a tobacco having a higher inlet temperature during the heat treatment and in particular better fillability levels can be obtained, particularly with material which can only undergo limited swelling.

Several means are suitable for obtaining the minimum inlet temperature of the tobacco which is required for the subsequent heat treatment according to the present invention. According to the invention, the autoclave temperature can be reduced, e.g., by means of a jacket cooling, to such an extent that part of the compression heat is removed.

The tobacco can be introduced in the reactor and precooled preferably to just above the freezing point of the water contained in the tobacco.

According to a preferred embodiment of the present novel process, the treatment gas can be supplied to the autoclave in cooled form. This compensates for the heat of compression which builds up. As a consequence, the discharge temperature of the tobacco following decompression is considerably reduced.

The treatment gas may be cooled either prior to being introduced into the autoclave or while the gas is being introduced to autoclave. In the latter case, it is possible to cool the nitrogen or argon within the autoclave by circulating the gas through cooling means located outside of the autoclave.

Preferably and thus advantageously, the treating gas is introduced into an annular space within the autoclave. The annular space is defined on its outer side by the inner wall of the autoclave and on its inner side by a cylindrical wall having openings. The openings lead into the inner part of the autoclave. The main advantage of introducing the treatment gas through the openings of the cylinder wall forming the annular space is a better and more even distribution of the treating gas within the autoclave. The even gas distribution avoids forming a dense compact tobacco mass.

To avoid the formation of compacted or adhering material, it is also possible to introduce the treating gas into the autoclave from below or from the side of the autoclave. Alternatively, the formation of compact material is also avoided if, after having reached the final pressure, the treating gas is withdrawn either via the top or through the bottom of the autoclave.

A particular embodiment of the invention is quite economic. A procedure is employed wherein the compression and decompression are performed in cascade-like manner in a number of stages. Thus, an autoclave at a relatively low pressure is charged with a treatment gas under a higher pressure coming from another autoclave, which gas is expanded in stages. Such a cascade-like compression and decompression not only serves to bring about a better utilization of the energy expended for the compression in the sense that the treatment gas under the higher pressure at the time of its decompression is used for the pressure build-up of the treatment gas in another reactor, but also for introducing a cooler treatment gas for the reactor filled with treatment gas by the reactor under a higher pressure, because the expansion enthalpy mainly leads to a cooler gas and to a much lesser extent to a cooling of the reactor wall and tobacco.

When the pressure increases and decreases occur in stepwise fashion, it is necessary to force the treatment gas into the final compression stage to attain the desired final pressure.

It is also advantageous if the gas entering the lower pressure reactor in the case of cascade-like pressure compression is additionally cooled during the transfer. This cooling can, for example, be obtained by means of the expansion enthalpy from the final decompression stage of a reactor.

It is also advantageous according to a further development of the inventive process, when the treatment gas or part thereof is supplied to the final compression stage in a subcooled form.

All these possibilities for the action and supply of the treatment gas and its decompression, including the supply of a precooled tobacco can be carried out individually or in combination, all that is important is that the minimum temperature of the tobacco supplied to the heat treatment is below 0° C. The swelling effect is improved by still lower inlet temperatures of the tobacco or the treatment material.

If the tobacco discharge temperature from the autoclave corresponds to the minimum tobacco inlet temperature for the heat treatment or is somewhat lower than the latter, it must be ensured that the tobacco is immediately supplied to the heat treatment and does not absorb heat on the way from the autoclave to the heat treatment station. since in the case of continuous installations with a number of autoclaves, the conveying paths up to the heat treatment station are relatively long, it is necessary according to another aspect of the invention to insulate the tobacco against heat absorption following decompression. The insulation means that after discharge from the autoclave, the tobacco temperature does not rise above the tobacco inlet temperature for the heat treatment required by the present invention. This can, for example, be achieved by storing the freshly discharged tobacco in covered insulating vessels or by supplying the freshly discharged tobacco to the heat treatment by means of a cooling tunnel, the energy for maintaining a lower ambient temperature in the cooling tunnel, e.g., being obtainable through the decompression enthalphy of the final stage of cascade decompression.

The times or periods for building up the pressure should be selected in such a way to avoid too strong a heating of the tobacco. The time period during which the autoclave is decompressed (pressure release time) is in the range of about 0.5 minute to about 10 minutes.

In the diagram of FIG. 1, there are in all 12 autoclaves, 1, 2 . . . 12, which are supplied with treatment gas by means of a main line 20 and branch lines 21. This treatment gas passes from a liquid gas container 24, which, e.g., contains liquid nitrogen, via an evaporator 26 into a storage tank 28, from where the treatment gas is supplied under a certain initial pressure of, e.g., 2 to 10 or even 12 bar via a line 30 to a compressor 22 and from there is forced into the main line 20.

The reactors are also interconnected by means of connecting lines 23, the opening and closing of the valves for the connecting lines being electronically controlled.

As indicated by the arrow 40, the individual autoclaves are supplied with tobacco from above. The tobacco has a random moisture content of 10 to 30% by weight water and preferably 12 to 24% by weight water, whilst the tobacco additives, such as cloves, can appropriately have a higher moisture content of, e.g., 50%. The tobacco feed-in temperature can correspond to ambient temperature. However, as a function of the pre-treatment of the cut tobacco, it can also be higher and in the case of an inventive variant of the present process, can also be just above the freezing point of the water present in the tobacco.

Following the pressure treatment and the decompression of the treatment gas, the tobacco is supplied by conveyor belts 42 to a dosing and distributing device 44 where, spread out on a belt, it is supplied to a heat treatment station 46. The latter is preferably a saturated steam treatment tunnel, but can also be a station with a different heat supply.

in the process according to the invention, it is important that in connection with heat treatment station 46, the inlet temperature of the tobacco for the heat treatment is below 0° C. The tobacco swells spontaneously on passing through the heat treatment station. As a function of the temperature, the saturated steam can have a water vapour density of 0.5 to 10 kg/m$^3$. Higher saturated steam densities or a higher temperature saturated steam should generally be avoided for economic reasons and to prevent damage to the tobacco, although it is important during said heat treatment to supply the tobacco which is at its minimum inlet temperature of below 0° C., with thermal energy as rapidly as possible, so that the swelling effect assumes a maximum value.

The swollen tobacco made overmoist by the saturated steam is then passed through a drying tunnel 48 and a following cooling means 50, in order to be removed for further processing at the desired processing moisture content and temperature.

In order to prevent heating of the tobacco, which is, e.g., discharged from the autoclave at a temperature of −40° C., the conveyor belts 42 can be surrounded by a cooling tunnel 52. In place of cooling tunnel 52, the tobacco can also be conveyed in thermally insulated storage containers (not shown), it then being supplied batchwise to the heat treatment station 46 by means of dosing device 44. This permits a more flexible operation.

According to a preferred embodiment of the invention, it is possible to supply by means of a separate line 54 liquid treatment gas directly to the line system 21, preferably during the final stage of the compression. In line 30, upstream of compressor 22 or in lines 20 or 21, it is also possible to additionally cool the treatment gas by a cooling unit (not shown). Cooling units can also be provided in the connecting lines 23 between the individual autoclaves.

Figure 2:
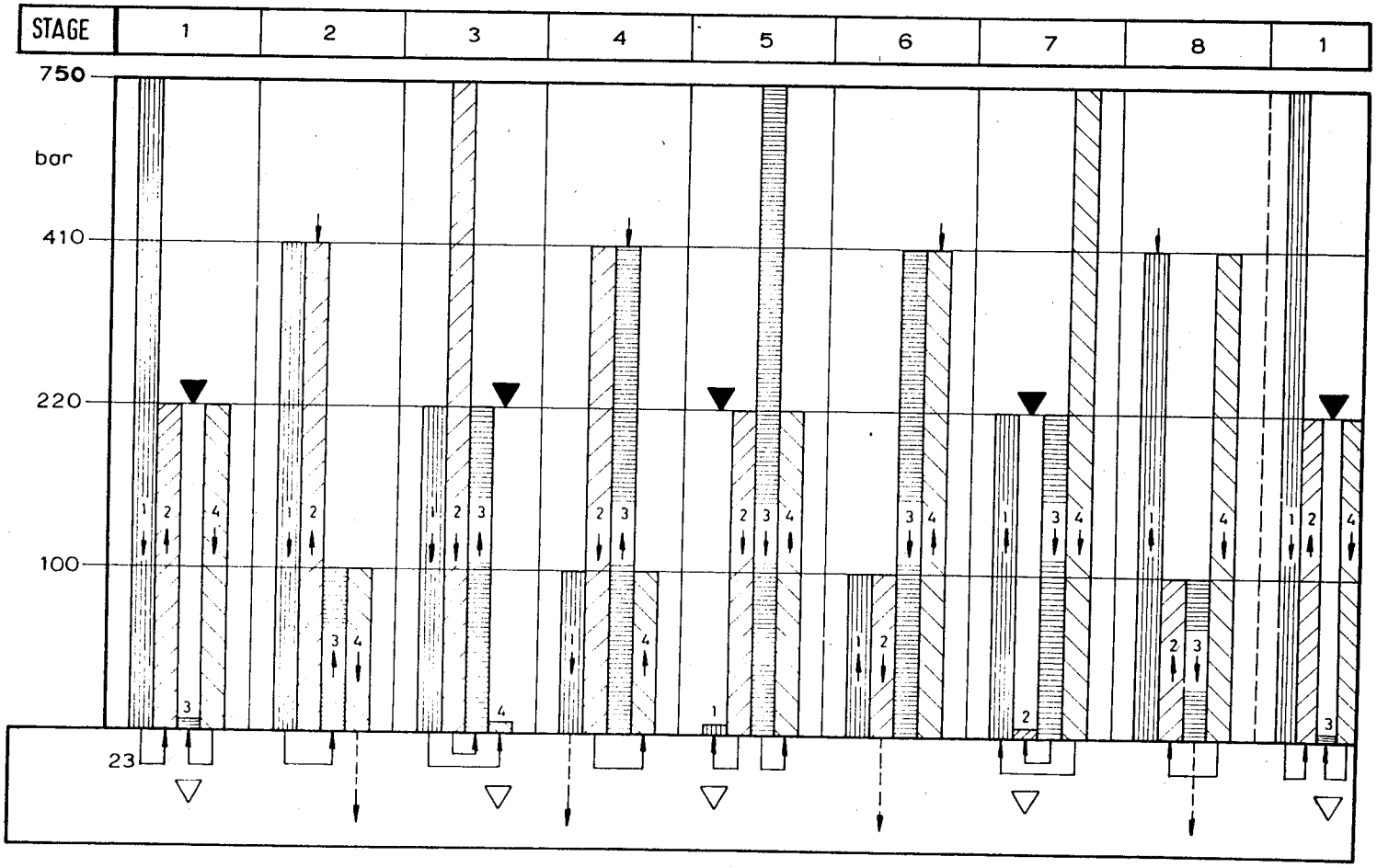
FIG. 2 a diagrammatic view of a preferred embodiment of the cascade principle.

In the case of the exemplified representation of the preferred cascade principle according to the invention shown in FIG. 2, working takes place with four autoclaves, pressure build-up and decompression taking place in each case in four stages, i.e. 8 stages in all.

In the first stage, autoclave 1 is at a pressure of 750 bar and for decompression purposes, is connected via connecting line 23 to autoclave 2, which is under a pressure of 220 bar and is also subject to compressed gas action. Autoclave 3, which is at normal pressure and which has just been supplied with tobacco, is connected by a further connecting line with autoclave 4, which contains a treatment gas under a pressure of 220 bar and is to be further expanded.

In stage 2, a pressure compensation has taken place between autoclaves 1 and 2, whose treatment gas is in both cases at 410 bar. Autoclaves 3 and 4 have a pressure of 100 bar as a result of the pressure compensation. The further decompression of autoclave 1 takes place by means of a connection with autoclave 3 and autoclave 2 is further supplied with compressed gas by means of the compressor or is supplied with the liquified treatment gas. Autoclave 4 is expanded and the treatment gas is led off into tank 28. The expansion enthalpy can be used for cooling the treatment gas.

A pressure compensation between autoclaves 1 and 3 has been achieved in stage 3 where the treatment gas in autoclave 1 has dropped from 410 to 220bar and the treatment gas in autoclave 3 has risen from 100 to 220 bar. Autoclave 2, which has been brought to the final treatment pressure of 750 bar is now ready for decompression. The gas treated in autoclave 4 is discharged and is replaced by new, optionally precooled tobacco. By connecting autoclave 1 to autoclave 4, the former is further expanded and the latter is supplied again with treatment gas. Autoclave 3 is subject to further action through the connection with autoclave 2, which is ready for compression.

In stage 4, equilibrium has been established between autoclave 1 which is in the decompression stage and which has dropped to 100 bar and autoclave 4 which has gone up to 100 bar, whilst autoclaves 2 and 3 have been brought to 410 bar by corresponding compensation. Autoclave 1 is expanded and the treatment gas is transferred into the storage tank 28, optionally using the expansion enthalpy for cooling a treatment gas supplied at another point. Autoclave 3 is supplied with further optionally precooled treatment gas to a pressure of 750 bar, unless liquid gas is injected according to a preferred form of the process according to the invention. The further stages 5 to 8 are carried out in the same way as described hereinbefore.

The process can comprise, consist essentially of, or consist of the recited steps with the stated materials.

EXAMPLE 1

Figure 3:
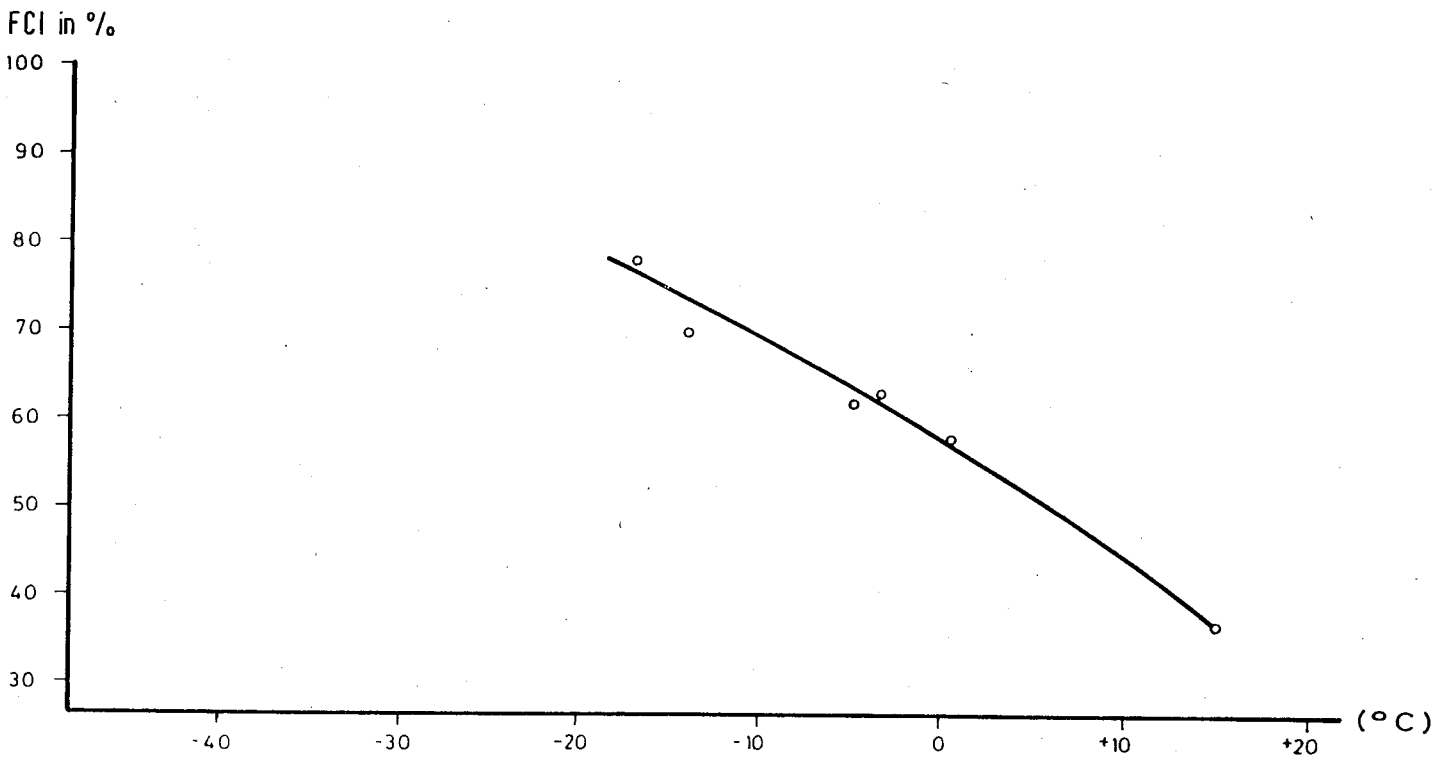
FIG. 3 a graph showing the dependence of the fillability improvement FCI in % on the inlet temperature of the tobacco for the heat treatment.

30 kg of a finished tobacco mixture are treated in a 200 liter autoclave with nitrogen up to a final pressure of 750 bar, whilst maintaining different inlet temperatures during the heat treatment. The mean values of the percentage fillability improvement obtained from 2 to 4 mixtures are given in the graph according to FIG. 3, where they are plotted against inlet temperatures determined in the conventional manner. The curve clearly shows the excellent fillability improvement of filling capacity increase (FCI in %).

EXAMPLE 2

To show the influence of cooling the mantle of the autoclave with respect to improving the filling capacity the following test was made:

30 kg of a cut tobacco mixture were treated in a 200 liter autoclave with nitrogen up to a final pressure of 750 bar by maintaining different temperatures of the cooling water of the autoclave. All other parameters were identical for all runs. The results are as follows:

| Temperature of the Cooling Water in °C. | Temperature of the Tobacco After Removal From The Autoclave in °C. | Filling Capacity Increase in % |
|---|---|---|
| +12 | −40 | +65 |
| +31 | −10 | +52 |
| +50 | +10 | +39 |

EXAMPLE 3

To show the influence of insulation the tobacco removed from the autoclave against warming up to room temperature the following tests were made:

30 kg of a cut mixture were treated in a 200 liter autoclave with nitrogen up to a final pressure of 750 bar with constant cooling of the mantle of the autoclave. After release of the pressure the tobacco was subjected to the heat treatment directly after removal from the autoclave, i.e., ex autoclave, after storing at a temperature of −50° C. for a period of 20 hours and after storing for a period of 20 hours at ambient temperature. The results are as follows:

| | Temperature of the Tobacco in °C. | Filing Capacity Improvement % |
|---|---|---|
| Ex autoclave | −45 | +72 |
| After 20 hours storing at −50° C. | −50 | +70 |
| After 20 hours storing at room temperature | +5 | +35 |

What is claimed is:

1. In a process for improving the fillability of tobacco by treatment with a treatment gas containing at least one of the following: nitrogen gas, argon gas or a mixture thereof at pressures up to 1000 bar in an autoclave, decompressing the tobacco, and subjecting the tobacco to a heat treatment, the improvement comprising:

supplying the autoclave with both tobacco and treatment gas and decompressing the treated tobacco in such manner that the decompressed tobacco supplied to the subsequent heat treatment has an inlet temperature for the heat treatment of below 0° C., said treatment gas being non-polar.

2. A process according to claim 1, comprising cooling the treatment gas not later than when it is supplied to the autoclave.

3. A process according to claim 2, comprising cooling the autoclave in which the tobacco is treated with the treatment gas.

4. A process according to claim 1 comprising cooling the autoclave in which the tobacco is treated with the treatment gas.

5. A process according to claim 1, comprising cooling the tobacco prior to its introduction into the autoclave.

6. A process according to claim 4, comprising cooling the tobacco prior to its introduction into the autoclave.

7. A process according to claim 1, comprising injecting subcooled or liquefied treatment gas into the autoclave during the treatment of the tobacco with the treatment gas.

8. A process according to claim 1, said process further comprising providing a plurality of autoclaves;

cascading said autoclaves wherein treatment gas from one autoclave under a high pressure is introduced into at least one other autoclave, said other autoclave being at an initial pressure less than said one autoclave, whereby said one autoclave is decompressed while said other autoclave is pressurized.

9. A process according to claim 8, said process further comprising:

carrying out the pressurization and the decompression in a stepwise manner, the pressurization including forcing additional treatment gas into a said other autoclave during the final compression stage to obtain the desired final pressure.

10. A process according to claim 9, said process further comprising:

additionally cooling the treatment gas supplied from a said one autoclave during the transfer of said gas to a said other autoclave.

11. A process according to claim 8, said process further comprising:

additionally cooling the treatment gas supplied from a said one autoclave during the transfer to a said other autoclave which is at a lower pressure.

12. A process according to claim 8, said process further comprising:

charging the autoclave during the final stage of the compression with subcooled or liquified treatment gas.

13. A process according to claim 1 comprising subjecting the tobacco to low temperature insulation after decompression and up to the subsequent heat treatment to prevent premature heating.

14. A process according to claim 1, comprising carrying out the subsequent heat treatment either with (1) water vapour in the form of saturated steam or (2) with water vapour having a density of 0.5 to 10 kg/m$^3$ or (3) with hot air having a temperature up to 440° C.

15. A process according to claim 14 wherein the subsequent heat treatment is carried out either with (1) water vapour in the form of saturated steam or (2) with water vapour having a density of 0.5 to 10 kg/m$^3$.

16. A process according to claim 1, comprising introducing the treating gas into the autoclave from below or from the side.

17. A process according to claim 1, comprising decompressing the autoclave via the top or through the bottom after the final pressure is reached.

18. A process according to claim 1, comprising introducing the treating gas into an annular space within the autoclave, said annular space being defined in its outer configuration by the inner wall of the autoclave and in its inner configuration by a cylindrical wall having openings leading into the inner part of the autoclave.

* * * * *